US008340965B2

(12) United States Patent
Yan et al.

(10) Patent No.: US 8,340,965 B2
(45) Date of Patent: Dec. 25, 2012

(54) RICH CONTEXT MODELING FOR TEXT-TO-SPEECH ENGINES

(75) Inventors: Zhi-Jie Yan, Beijing (CN); Yao Qian, Beijing (CN); Frank Kao-Ping Soong, Beijing (CN)

(73) Assignee: Microsoft Corporation, Redmond, WA (US)

( * ) Notice: Subject to any disclaimer, the term of this patent is extended or adjusted under 35 U.S.C. 154(b) by 489 days.

(21) Appl. No.: 12/629,457

(22) Filed: Dec. 2, 2009

(65) Prior Publication Data

US 2011/0054903 A1 Mar. 3, 2011

Related U.S. Application Data

(60) Provisional application No. 61/239,135, filed on Sep. 2, 2009.

(51) Int. Cl.
*G10L 13/00* (2006.01)

(52) U.S. Cl. ..... 704/258; 704/256.3; 704/266

(58) Field of Classification Search ..... 704/256.2, 704/256.3, 258, 260, 266, 269
See application file for complete search history.

(56) References Cited

U.S. PATENT DOCUMENTS

| | | | | |
|---|---|---|---|---|
| 5,286,205 | A | 2/1994 | Inouye et al. | |
| 5,358,259 | A | 10/1994 | Best | |
| 6,032,116 | A | 2/2000 | Asghar et al. | |
| 6,199,040 | B1 | 3/2001 | Fette et al. | |
| 6,453,287 | B1 | 9/2002 | Unno et al. | |
| 6,775,649 | B1 | 8/2004 | DeMartin | |
| 7,092,883 | B1 * | 8/2006 | Gretter et al. | 704/242 |
| 7,496,512 | B2 | 2/2009 | Zhao et al. | |
| 7,562,010 | B1 * | 7/2009 | Gretter et al. | 704/9 |
| 7,574,358 | B2 * | 8/2009 | Deligne et al. | 704/243 |
| 7,603,272 | B1 * | 10/2009 | Hakkani-Tur et al. | 704/232 |
| 8,244,534 | B2 * | 8/2012 | Qian et al. | 704/256.3 |
| 2002/0029146 | A1 * | 3/2002 | Nir | 704/260 |
| 2003/0088416 | A1 * | 5/2003 | Griniasty | 704/256 |
| 2003/0144835 | A1 | 7/2003 | Zinser, Jr. et al. | |
| 2005/0057570 | A1 | 3/2005 | Cosatto et al. | |
| 2007/0033044 | A1 * | 2/2007 | Yao | 704/256.3 |
| 2007/0212670 | A1 | 9/2007 | Paech et al. | |
| 2007/0213987 | A1 | 9/2007 | Turk et al. | |
| 2007/0233490 | A1 * | 10/2007 | Yao | 704/260 |
| 2007/0276666 | A1 * | 11/2007 | Rosec et al. | 704/260 |
| 2008/0059190 | A1 | 3/2008 | Chu et al. | |
| 2008/0082333 | A1 | 4/2008 | Nurminen et al. | |
| 2008/0195381 | A1 | 8/2008 | Soong et al. | |
| 2009/0006096 | A1 | 1/2009 | Li et al. | |
| 2009/0048841 | A1 | 2/2009 | Pollet et al. | |
| 2009/0055162 | A1 | 2/2009 | Qian et al. | |

(Continued)

OTHER PUBLICATIONS

Nose et al., "A Speaker Adaptation Technique for MRHSMM-Based Style Control of Synthetic Speech", IEEE International Conference on Acoustics, Speech and Signal Processing, 2007. ICASSP 2007. Apr. 15-20, 2007, vol. 4, pp. IV-833 to IV-836.*

(Continued)

*Primary Examiner* — Martin Lerner
(74) *Attorney, Agent, or Firm* — Lee & Hayes, PLLC

(57) ABSTRACT

Embodiments of rich context modeling for speech synthesis are disclosed. In operation, a text-to-speech engine refines a plurality of rich context models based on decision tree-tied Hidden Markov Models (HMMs) to produce a plurality of refined rich context models. The text-to-speech engine then generates synthesized speech for an input text based at least on some of the plurality of refined rich context models.

23 Claims, 8 Drawing Sheets

U.S. PATENT DOCUMENTS

| | | | | |
|---|---|---|---|---|
| 2009/0248416 | A1* | 10/2009 | Gorin et al. | 704/257 |
| 2009/0258333 | A1 | 10/2009 | Yu | |
| 2009/0310668 | A1 | 12/2009 | Sackstein et al. | |
| 2010/0057467 | A1* | 3/2010 | Wouters | 704/267 |
| 2010/0211376 | A1 | 8/2010 | Chen et al. | |
| 2012/0143611 | A1* | 6/2012 | Qian et al. | 704/260 |

OTHER PUBLICATIONS

Liang et al., "A Cross-Language State Mapping Approach to Bilingual (Mandarin-English) TTS", IEEE International Conference on Acoustics, Speech and Signal Processing, 2008. ICASSP 2008. Mar. 31, 2008 to Apr. 4, 2008, pp. 4641 to 4644.*

Qian et al., "A Cross-Language State Sharing and Mapping Approach to Bilingual (Mandarin-English) TSS", IEEE Transactions on Audio, Speech, and Language Processing, Aug. 2009, vol. 17, Issue 6, pp. 1231 to 1239.*

Qian et al., "HMM-based Mixed-language (Mandarin-English) Speech Synthesis", 6th International Symposium on Chinese Spoken Language Processing, 2008. ISCSLP '08. Dec. 16-19, 2008, pp. 1 to 4.*

Doenges, et al., "MPEG-4: Audio/Video & Synthetic Graphics/Audio for Mixed Media", Signal Processing: Image Communication, vol. 9, Issue 4, May 1997, pp. 433-463.

Perng, et al., "Image Talk: A Real Time Synthetic Talking Head Using One Single Image with Chinese Text-To-Speech Capability", Pacific Conference on Computer Graphics and Applications, Oct. 29, 1998, 9 pages.

Colotte et al., "Linguistic Features Weighting for a Text-To-Speech System Without Prosody Model", http://citeseerx.ist.psu.edu/viewdoc/download?doi=10.1.1.70.5121&rep=rep1&type=pdf, Interspeech 2005, Sep. 2005, 4 pgs.

Fernandez et al., "The IBM Submission to the 2008 Text-to-Speech Blizzard Challenge", Proc Blizzard Workshop, 2008, 6 pgs.

Huang et al., "Recent Improvements on Microsoft's Trainable Text-to-Speech System-Whistler", Proc ICASSP1997, 1997, vol. 2, 4 pgs.

Ling, et al, "HMM-Based Hierarchical Unit Selection Combining Kullback-Leibler Divergence with Likelihood Criterion" , Proc ICASSP 2007, IEEE Intl Conf, Apr. 2007, vol. 4, pp. 1245-1248.

Nukaga et al., "Unit Selection Using Pitch Synchronous Cross Correlation for Japanese Concatenative Speech Synthesis", <<http://www.ssw5.org/papers/1033.pdf>>, 5th ISCA Speech Synthesis Workshop, Jun. 2004, pp. 43-48.

Toda et al., "Speech Parameter Generation Algorithm Considering Gobal Variance for HMM-Based Speech Synthesis", Proc Eurospeech2005, Sep. 2005, pp. 2801-2804.

Tokuda et al., "Multispace Probability Distribution HMM", IEICE Trans Int & System, Mar. 2002, vol. E85-D, No. 3, pp. 455-464.

Tokuda et al., "Speech Parameter Generation Algorithms for HMM-Based Speech Synthesis", Proc ICASSP2000, 2000, vol. 3, 4 pgs.

Wang et al., "Trainable Unit Selection Speech Synthesis Under Statistical Framework", <<http://www.scichina.com:8080/kxtbe/fileup/PDF/09ky1963.pdf>>, Chinese Science Bulletin, Jun. 2009, 54: 1963-1969.

Wu, "Investigations on HMM Based Speech Synthesis" , Ph.D. dissertation, Univ of Science and Technology of China, 2006, 117 pgs.

Wu et al, "Minimum Generation Error Training for HMM-based Speech Synthesis", Proc ICASSP 2006, IEEE Intl Conf May 2006, pp. 89-92.

Yoshimura et al., "Simultaneous Modeling of Spectrum, Pitch and Duration in HMM-Based Speech Synthesis", Proc EuroSpeech 1999, 1999, vol. 5, 4 pgs.

Black, et al., "CMU Blizzard 2007: A Hybrid Acoustic Unit Selection System from Statistically Predicted Parameters", retrieved on Aug. 9, 2010 at <<http://www.cs.cmu.edu/~awb/papers/bc2007/blz3_005.pdf>>, The Blizzard Challenge, Bonn, Germany, Aug. 2007, pp. 1-5.

Black, et al., "Statistical Parametric Speech Synthesis", retrieved on Aug. 9, 2010 at <<http://www.cs.cmu.edu/~awb/papers/icassp2007/0401229.pdf>>, IEEE Proceedings of International Conference on Acoustics, Speech and Signal Processing (ICASSP), vol. 4, Apr. 2007, pp. 1229-1232.

Dimitriadis, et al., "Towards Automatic Speech Recognition in Adverse Environments", retrieved at <<http://www.aueb.gr/pympe/hercma/proceedings2005/H05-FULL-PAPERS-1/DIMITRIADIS-KATSSAMANIS-MARAGOS-PAPANDREOU-PITSIKALIS-1.pdf>>, WNSP05, Nonlinear Speech Processing Workshop, Sep. 2005, 12 pages.

Erro, et al., "Frame Alignment Method for Cross-Lingual Voice Conversion", retrieved at <<http://gps-tsc.upc.es/veu/research/pubs/download/err_fra_07.pdf>>, INTERSPEECH 2007, 8th Annual Conference of the International Speech Communication Association, Aug. 2007, 4 pages.

Gao, et al., "IBM MASTOR SYSTEM: Multilingual Automatic Speech-to-speech Translator", retrieved on Aug. 9, 2010 at <<http://www.aclweb.org/anthology/W/W06/W06-3711.pdf>>, Association for Computational Linguistics, Proceedings of Workshop on Medical Speech Translation, New York, NY, May 2006, pp. 53-56.

Gonzalvo, et al., "Local minimum generation error criterion for hybrid HMM speech synthesis", retrieved on Aug. 9, 2010 at <<http://serpens.salleurl.edu/intranet/pdf/385.pdf>>, ISCA Proceedings of INTERSPEECH, Brighton, UK, Sep. 2009, pp. 416-419.

Govokhina, et al., "Learning Optimal Audiovisual Phasing for an HMM-based Control Model for Facial Animation", retrieved on Aug. 9, 2010 at <<http://hal.archives-ouvertes.fr/docs/00/16/95/76/PDF/og_SSW07.pdf>>, Proceedings of ISCA Speech Synthesis Workshop (SSW), Bonn, Germany, Aug. 2007, pp. 1-4.

Hirai et al., "Utilization of an HMM-Based Feature Generation Module in 5 ms Segment Concatenative Speech Synthesis", SSW6-2007, Aug. 2007, pp. 81-84.

Kawai et al., "XIMERA: a concatenative speech synthesis system with large scale corpora", IEICE Trans. J89-D-II, No. 12, Dec. 2006, pp. 2688-2698.

Kuo, et al., "New LSP Encoding Method Based on Two-Dimensional Linear Prediction", IEEE Proceedings of Communications, Speech and Vision, vol. 10, No. 6, Dec. 1993, pp. 415-419.

Laroia, et al., "Robust and Efficient Quantization of Speech LSP Parameters Using Structured Vector Quantizers", retrieved on Aug. 9, 2010 at <<http://ieeexplore.ieee.org/stamp/stamp.jsp?tp=&arnumber=150421>>, IEEE Proceedings of International Conference on Acoustics, Speech and Signal Processing (ICASSP), May 1991, pp. 641-644.

Liang, et al. "An HMM-Based Bilingual (Mandarin-English) TTS", retrieved at <<http://www.isca-speech.org/archive_open/ssw6/ssw6_137.html>>6th ISCA Workshop on Speech Synthesis, Aug. 2007, pp. 137-142.

McLoughlin, et al., "LSP Analysis and Processing for Speech Coders", IEEE Electronics Letters, vol. 33, No. 9, Apr. 1997, pp. 743-744.

Paliwal, "A Study of LSF Representation for Speaker-Dependent and Speaker-Independent HMM-Based Speech Recognition Systems", International Conference on Acoustics, Speech, and Signal Processing (ICASSP-90), Apr. 1990, pp. 801-804.

Paliwal, "On the Use of line Spectral Frequency Parameters for Speech Recognition", Digital Signal Processing, vol. 2, No. 2, Apr. 1992, pp. 80-87.

Pellom, et al., "An Experimental Study of Speaker Verification Sensitivity to Computer Voice-Altered Imposters", IEEE ICASSP-99: Inter. Conf. on Acoustics, Speech, and Signal Processing, vol. 2, Mar. 1999, pp. 837-840.

Plumpe, et al., "HMM-Based Smoothing for Concatenative Speech Synthesis", retrieved on Aug. 9, 2010 at <<http:// research.microsoft.com/pubs/77506/1998-plumpe-icslp.pdf>>, Proceedings of International Conference on Spoken Language Processing (ICSLP), Sydney, Australia, vol. 6, Dec. 1998, pp. 2751-2754.

Qian et al., "A Minimum V/U Error Approach to F0 Generation in HMM-Based TTS," INTERSPEECH-2009, Sep. 2009, pp. 408-411.

Qian, et al., "An HMM Trajectory Tiling (HTT) Approach to High Quality TTS", retrieved at <<http://festvox.org/blizzard/bc2010/MSRA_%20Blizzard2010.pdf>>, Microsoft Entry to Blizzard Challenge 2010, Sep. 25, 2010, 5 pages.

Qian et al., "An HMM-Based Mandarin Chinese Text-To-Speech System ," ISCSLP 2006, Springer LNAI vol. 4274, Dec. 2006 , pp. 223-232.

Sirotiya, et al., "Voice Conversion Based on Maximum-Likelihood Estimation of Speech Parameter Trajectory", retrieved on Nov. 17, 2010 at <<http://ee602.wdfiles.com/local--files/report-presentations/Group_14>>, Indian Institute of Technology, Kanpur, Apr. 2009, 8 pages.
Soong, et al., "Line Spectrum Pair (LSP) and Speech Data Compression", retrieved on Aug. 9, 2010 at <<http://ieeexplore.ieee.org/stamp/stamp.jsp?tp=&arnumber=1172448>>, IEEE Proceedings of Acoustics, Speech, and Signal Processing (ICASSP), vol. 1, San Diego, CA, Mar. 1984, pp. 1.10.1-1.10.4.
Soong, et al., "Optimal Quantization of LSP Parameters", IEEE Transactions on Speech and Audio Processing, vol. 1, No. 1, Jan. 1993, pp. 15-24.
Sugamura, et al., "Quantizer Design in LSP Speech Analysis and Synthesis", 1988 International Conference on Acoustics, Speech, and Signal Processing, vol. 1, Apr. 1988, pp. 398-401.
SynSIG, "Blizzard Challenge 2010", retrieved on Aug. 9, 2010 at <<http://www.synsig.org/index.php/Blizzard_Challenge_2010>>, International Speech Communication Association (ISCA), SynSIG, Aug. 2010, pp. 1.
Toda, et al., "Trajectory Training Considering Global Variance for HMM-Based Speech Synthesis", retrieved on Aug. 9, 2010 at <<http://ieeexplore.ieee.org/stamp/stamp.jsp?arnumber=04960511>>, IEEE International Conference on Acoustics, Speech and Signal Processing (ICASSP), Taipei, Apr. 2009, pp. 4025-4028.
Toda, et al., "Voice Conversion Based on Maximum-Likelihood Estimation of Spectral Parameter Trajectory", IEEE Transactions on Audio, Speech, and Language Processing, vol. 15, No. 8, Nov. 2007, pp. 2222-2235.
Wu, et al., "Minimum Generation Error Criterion Considering Global/Local Variance for HMM-Based Speech Synthesis", retrieved on Aug. 9, 2010 at <<http://ieeexplore.ieee.org/stamp/stamp.jsp?arnumber=04518686>>, IEEE International Conference on Acoustics, Speech and Signal Processing (ICASSP), Las Vegas, NV, Apr. 3, 2008, pp. 4621-4624.
Yan, et al., "Rich-context unit selection (RUS) approach to high quality TTS", retrieved on Aug. 10, 2010 at <<http://ieeexplore.ieee.org/stamp/stamp.jsp?tp=&arnumber=5495150>>, IEEE Proceedings of International Conference on Acoustics, Speech and Signal Processing (ICASSP), Mar. 2010, pp. 4798-4801.
Young, et al., "The HTK Book", Cambridge University Engineering Department, Dec. 2001 Edition, 355 pages.

* cited by examiner

RICH CONTEXT MODELING FOR TEXT-TO-SPEECH ENGINES

CROSS REFERENCE TO RELATED APPLICATIONS

This application claims priority to U.S. Provisional Patent Application No. 61/239,135 to Yan et al., entitled "Rich Context Modeling for Text-to-Speech Engines", filed on Sep. 2, 2009, and incorporated herein by reference.

BACKGROUND

A text-to-speech engine is a software program that generates speech from inputted text. A text-to-speech engine may be useful in applications that use synthesized speech, such as a wireless communication device that reads incoming text messages, a global positioning system (GPS) that provides voice directional guidance, or other portable electronic devices that present information as audio speech.

Many text-to-speech engines use Hidden Markov Model (HMM) based text-to-speech synthesis. A variety of contextual factors may affect the quality of synthesized of human speech. For instance, parameters such as spectrum, pitch and duration may interact with one another during speech synthesis. Thus, important contextual factors for speech synthesis may include, but are not limited to, phone identity, stress, accent, position. In HMM-based speech synthesis, the label of the HMMs may be composed of a combination of these contextual factors. Moreover, conventional HMM-based speech synthesis also uses a universal Maximum Likelihood (ML) criterion during both training and synthesis. The ML criterion is capable of estimating statistical parameters of the HMMs. The ML criterion may also impose a static-dynamic parameter constraint during speech synthesis, which may help to generate a smooth parametric trajectory that yields highly intelligible speech.

However, speech synthesized using conventional HMM-based approaches may be overly smooth, as ML parameter estimation after decision tree-based tying usually leads to highly averaged HMM parameters. Thus, speech synthesized using the conventional HMM-based approaches may become blurred and muffled. In other words, the quality of the synthesized speech may be degraded.

SUMMARY

Described herein are techniques and systems for using rich context modeling to generate Hidden Markov Model (HMM)-based synthesized speech from text. The use of rich context modeling, as described herein, may enable the generation of synthesized speech that is of higher quality (i.e., less blurred and muffled) than speech that is synthesized using conventional HMM-based speech synthesis.

The rich context modeling described herein initially uses a special training procedure to estimate rich context model parameters. Subsequently, speech may be synthesized based on the estimated rich context model parameters. The spectral envelopes of the speech synthesized based on the rich context models may have crisper formant structures and richer details than those obtained from conventional HMM-based speech synthesis.

In at least one embodiment, a text-to-speech engine refines a plurality of rich context models based on decision tree-tied Hidden Markov Models (HMMs) to produce a plurality of refined rich context models. The text-to-speech engine then generates synthesized speech for an input text based at least on some of the plurality of refined rich context models.

This Summary is provided to introduce a selection of concepts in a simplified form that is further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference number in different figures indicates similar or identical items.

DETAILED DESCRIPTION

The embodiments described herein pertain to the use of rich context modeling to generate Hidden Markov Model (HMM)-based synthesized speech from input text. Many contextual factors may affect HMM-based synthesis of human speech from input text. Some of these contextual factors may include, but are not limited to, phone identity, stress, accent, position. In HMM-based speech synthesis, the label of the HMMs may be composed of a combination of context factors. "Rich context models", as used herein, refer to these HMMs as they exist prior to decision-tree based tying. Decision tree-based tying is an operation that is implemented in conventional HMM-based speech synthesis. Each of the rich context models may carry rich segmental and suprasegmental information.

The implementation of text-to-speech engines that uses rich context models in HMM-based synthesis may generate speech with crisper formant structures and richer details than those obtained from conventional HMM-based speech synthesis. Accordingly, the use of rich context models in HMM-based speech synthesis may provide synthesized speech that is more natural sounding. As a result, user satisfaction with embedded systems, server system, and other computing systems that present information via synthesized speech may be increased at a minimal cost. Various example use of rich context models in HMM-based speech synthesis in accordance with the embodiments are described below with reference to FIGS. 1-8.

Example Scheme

Figure 1:
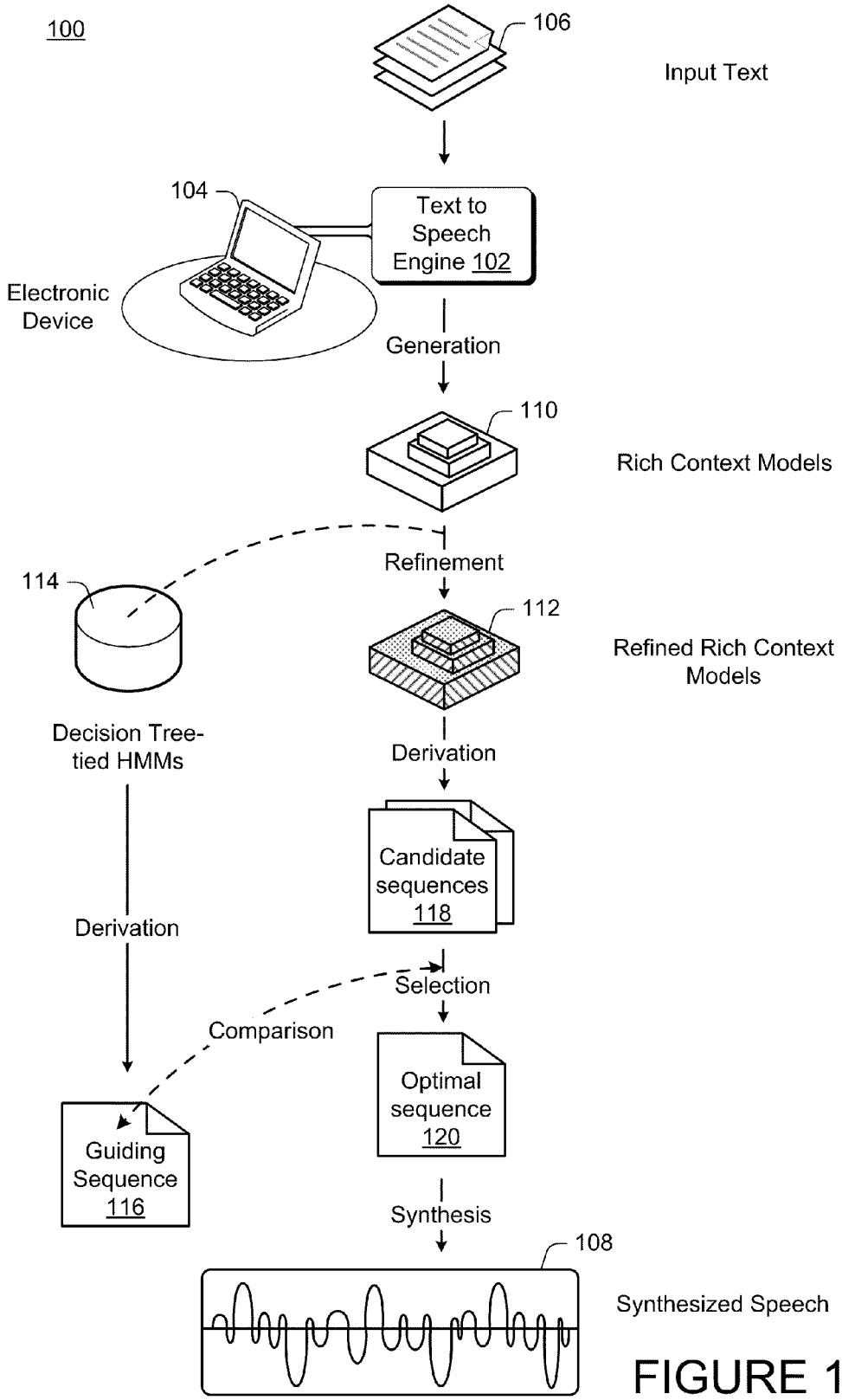
FIG. 1 is a block diagram that illustrates an example scheme that implements rich context modeling on a text-to-speech engine to synthesize speech from input text, in accordance with various embodiments.

FIG. 1 is a block diagram that illustrates an example scheme that implements rich context modeling on a text-to-speech engine 102 to synthesize speech from input text, in accordance with various embodiments.

The text-to-speech engine 102 may be implemented on an electronic device 104. The electronic device 104 may be a portable electronic device that includes one or more processors that provide processing capabilities and a memory that provides data storage/retrieval capabilities. In various embodiments, the electronic device 104 may be an embedded system, such as a smart phone, a personal digital assistant (PDA), a digital camera, a global position system (GPS) tracking unit, or the like. However, in other embodiments, the electronic device 104 may be a general purpose computer, such as a desktop computer, a laptop computer, a server, or the like. Further, the electronic device 104 may have network capabilities. For example, the electronic device 104 may exchange data with other electronic devices (e.g., laptops computers, servers, etc.) via one or more networks, such as the Internet.

The text-to-speech engine 102 may ultimately convert the input text 106 into synthesized speech 108. The input text 106 may be inputted into the text-to-speech engine 102 as electronic data (e.g., ACSCII data). In turn, the text-to-speech engine 102 may output synthesized speech 108 in the form of an audio signal. In various embodiments, the audio signal may be electronically stored in the electronic device 104 for subsequent retrieval and/or playback. The outputted synthesized speech 108 (i.e., audio signal) may be further transformed by electronic device 104 into an acoustic form via one or more speakers.

During the conversion of input text 106 into synthesized speech 108, the text-to-speech engine 102 may generate rich context models 110 from the input text 106. The text-to-speech engine 102 may further refine the rich context models 110 into refined rich context models 112 based on decision tree-tied Hidden Markov Models (HMMs) 114. In various embodiments, the decision tree-tied HMMs 114 may also be generated by the text-to-speech engine 102 from the input text 106.

Subsequently, the text-to-speech engine 102 may derive a guiding sequence 116 of HMM models from the decision tree-tied HMMs 114 for the input text 106. The text-to-speech engine 102 may also generate a plurality of candidate sequences of rich context models 118 for the input text 106. The text-to-speech engine 102 may then compare the plurality of candidate sequences 118 to the guiding sequence of HMM models 116. The comparison may enable the text-to-speech engine 102 to obtain an optimal sequence of rich context models 120 from the plurality of candidate sequences 118. The text-to-speech engine 102 may then produce synthesized speech 108 from the optimal sequence 120.

Example Components

Figure 2:
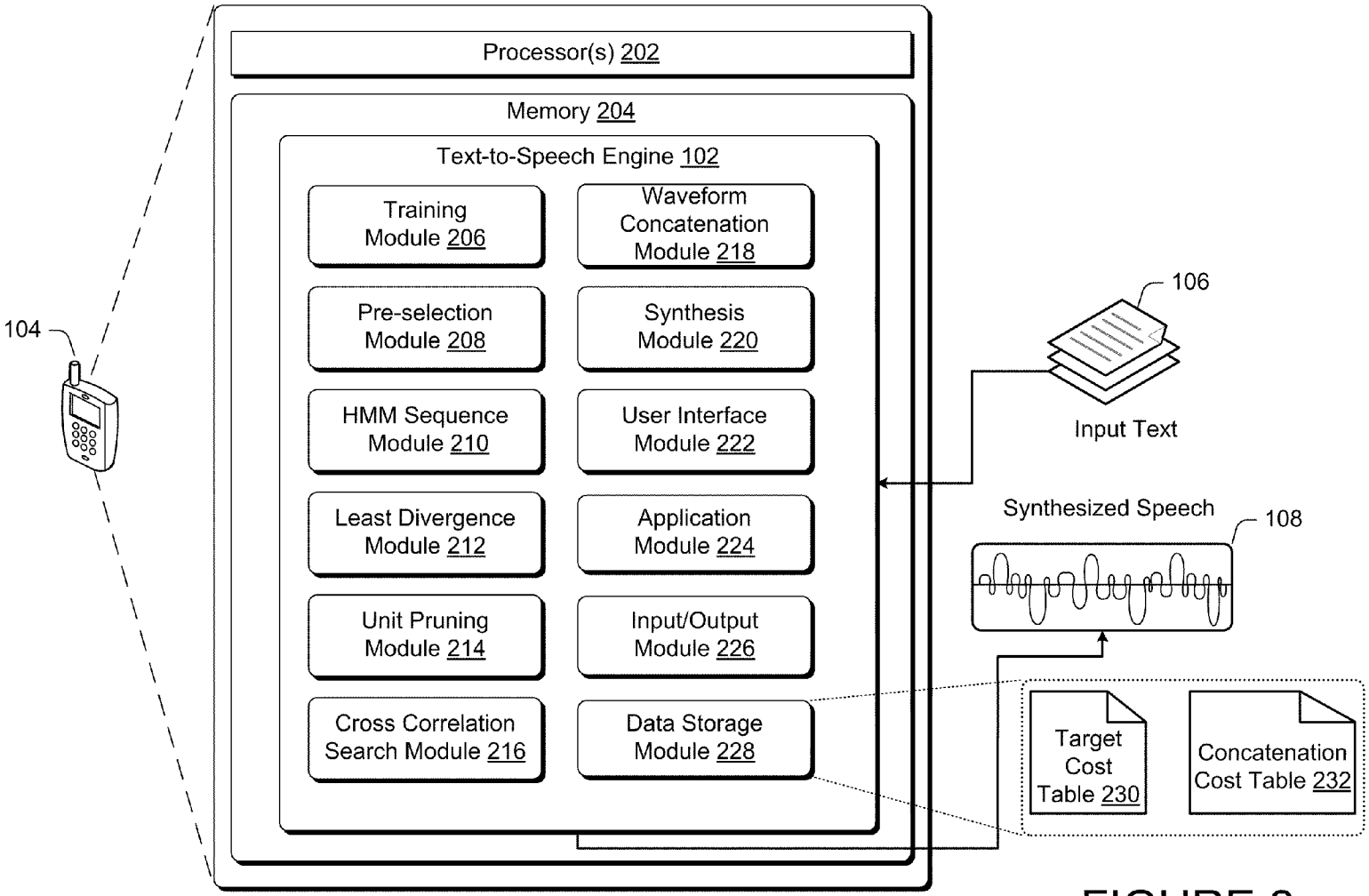
FIG. 2 is a block diagram that illustrates selected components of an example text-to-speech engine that provides rich context modeling, in accordance with various embodiments.

FIG. 2 is a block diagram that illustrates selected components of an example text-to-speech engine 102 that provides rich context modeling, in accordance with various embodiments.

The selected components may be implemented on an electronic device 104 (FIG. 1) that may include one or more processors 202 and memory 204. For example, but not as a limitation, the one or more processors 202 may include a reduced instruction set computer (RISC) processor.

The memory 204 may include volatile and/or nonvolatile memory, removable and/or non-removable media implemented in any method or technology for storage of information, such as computer-readable instructions, data structures, program modules or other data. Such memory may include, but is not limited to, random access memory (RAM), read-only memory (ROM), electrically erasable programmable read-only memory (EEPROM), flash memory or other memory technology; CD-ROM, digital versatile disks (DVD) or other optical storage; magnetic cassettes, magnetic tape, magnetic disk storage or other magnetic storage devices; and RAID storage systems, or any other medium which can be used to store the desired information and is accessible by a computer system. Further, the components may be in the form of routines, programs, objects, and data structures that cause the performance of particular tasks or implement particular abstract data types.

The memory 204 may store components of the text-to-speech engine 102. The components, or modules, may include routines, programs instructions, objects, and/or data structures that perform particular tasks or implement particular abstract data types. The components may include a training module 206, a pre-selection module 208, a HMM sequence module 210, a least divergence module 212, a unit pruning module 214, a cross correlation search module 216, a waveform concatenation module 218, and a synthesis module 220. The components may further include a user interface module 222, an application module 224, an input/output module 226, and a data storage module 228.

The training module 206 may train a set of rich context models 110, and in turn, a set of decision tree-tied HMMs 114, to model speech data. For example, the set of HMMs 114 may be trained via, e.g., a broadcast news style North American English speech sample corpus for the generation of American-accented English speech. In other examples, the set of HMMs 114 may be similarly trained to generate speech in other languages (e.g., Chinese, Japanese, French, etc.). In various embodiments, the training module 206 may initially derive the set of rich context models 110. In at least one embodiment, the rich context models may be initialized by cloning mono-phone models.

The training module 106 may estimate the variance parameters for the set of the rich context models 110. Subsequently, the training module 206 may derive the decision tree-tied HMMs 114 from the set of rich context models 110. In at least one embodiment, a universal Maximum Likelihood (ML) criterion may be used to estimate statistical parameters of the set of decision tree-tied HMMs 114.

The training module 206 may further refine the set of rich context models 110 based on the decision tree-tied HMMs 114 to generate a set of refined rich context models 112. In various embodiments of the refinement, the training module 206 may designate the set of decision-tree tied HMMs 114 as a reference. Based on the reference, the training module 206 may perform a single pass re-estimation to estimate the mean parameters for the set of rich context models 110. This re-estimation may rely on the set of decision tree-tied HMMs 114 to obtain the state-level alignment of the speech corpus. The mean parameters of the set of rich context models 110 may be estimated according to the alignment.

Subsequently, the training module 206 may tie the variance parameters of the set of rich context models 110 using a conventional tree structure to generate the set of refined context rich models 112. In other words, the variance parameters of the set of rich context models 110 may be set to be equal to the variance parameters of the set of decision tree-tied HMMS 114. In this way, the data alignment of the rich context models during training may be insured by the set of the decision tree-tied HMMs 114. As further described below, the refined rich context models 112 may be stored in a data storage module 228.

The pre-selection module 208 may compose a rich context model candidate sausage. The composition of a rich context model candidate sausage may be the first step in the selection and assembly of a sequence of rich context models that represents the input text 106 from the set of refined context models 112.

In some embodiments, the pre-selection module 208 may initially extract the tri-phone-level context of each target rich context label of the input text 106 to form a pattern. Subsequently, the pre-selection module 208 may chose one or more refined rich context models 112 that match this tri-phone pattern to form a sausage node of the rich candidate sausage. The pre-selection module 208 may further connect successive sausage nodes to compose a sausage node. The use of tri-phone-level, context based pre-selection by the pre-selection module 208 may maintain the size of sequence selection search space at a reasonable size. In other words, the tri-phone-level pre-selection may maintain a good balance between sequence candidate coverage and sequence selection search space size.

However, in alternative embodiments in which the pre-selection module 208 is unable to obtain a tri-phone pattern, the pre-selection module 208 may extract bi-phone level context of each target rich context label of the input text 106 to form a pattern. Subsequently, the pre-selection module 208 may chose one or more refined rich context models 112 that match this bi-phone pattern to form a sausage node.

Figure 3:
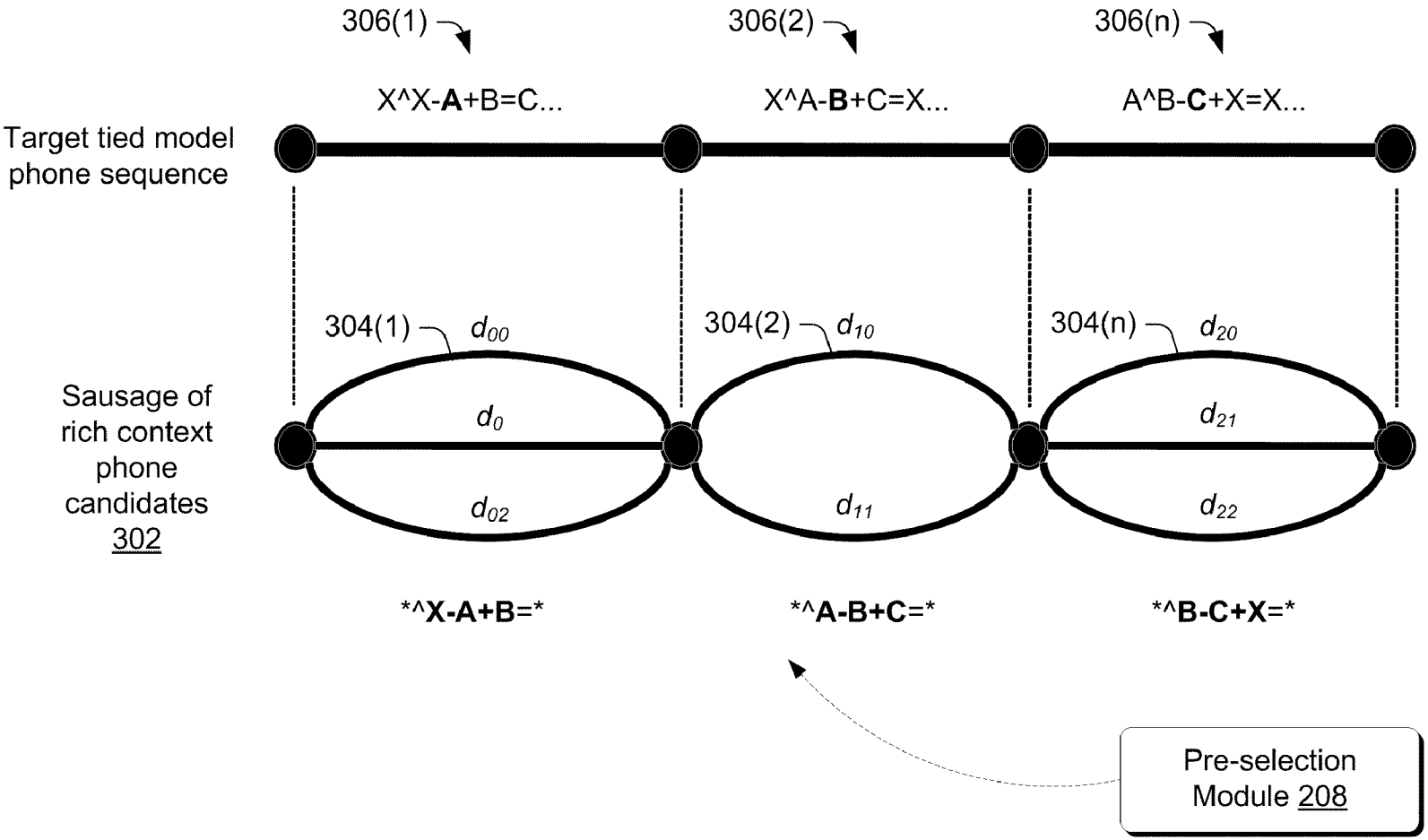
FIG. 3 is an example sausage of rich context model candidates, in accordance with various embodiments.

The pre-selection module 208 may connect successive sausage nodes to compose a rich context model candidate sausage, as shown in FIG. 3. The rich context model candidate sausage may encompass a plurality of rich context model candidate sequences 118.

FIG. 3 is an example rich context model candidate sausage 302, in accordance with various embodiments. The rich context model candidate sausage 302 may be derived by the pre-selection module 208 for the input text 106. Each of the nodes **304(1)-304(*n*) of the candidate sausage 302 may correspond to context factors of the target labels 306(1)-306(*n*), respectively. As shown in FIG. 3, some contextual factors of each target labels 306(1)-306(*n*)** are replaced by "..." for the sake of simplicity, and "*" may represent wildcard matching of all possible contextual factors.

Returning to FIG. 2, the HMM sequence module 210 may obtain a sequence of decision tree-tied HMMs that correspond to the input text 106. This sequence of decision tree-tied HMMs 114 is illustrated as the guiding sequence 116 in FIG. 1. In various embodiments, the HMM sequence module 210 may obtain the sequence of decision tree-tied HMMs from the set of decision tree-tied HMMs 114 using conventional techniques.

The least divergence module 212 may determine the optimal sequence 120 from a rich context model candidate sausage, such as the candidate sausage 302 of the input text 106. The optimal sequence 120 may be further used to generate a speech trajectory that is eventually converted into synthesized speech.

In various embodiments, the optimal sequence 120 may be a sequence of rich context models that exhibits a global trend that is "closest" to the guiding sequence 116. It will be appreciated that the guiding sequence 116 may provide an over-smoothed but stable trajectory. Therefore, by using this stable trajectory as a guide, the least divergence module 212 may select a sequence of rich context models, or optimal sequence 120, that has the smoothness of the guiding sequence 116 and the improved local speech fidelity provided by the refined rich context models 112.

The least divergence module 212 may search for the "closest" rich context model sequence by measuring the distance between the guiding sequence 116 and a plurality of rich context model candidate sequences 118 that are encompassed in the candidate sausage 302. In at least one embodiment, the least divergence module 212 may adopt an upper-bound of a state-aligned Kullback-Leibler divergence (KLD) approximation as the distance measure, in which spectrum, pitch, and duration information are considered simultaneously.

Thus, given $P=\{p_1, p_2, \ldots p_N\}$ as the decision tree-tied guiding sequence 116, the least divergence module 212 may determine the state-level duration of the guiding sequence 116 using the conventional duration model, which may be denoted as $T=\{t_1, t_2, \ldots t_N\}$. Further, for each of rich context model candidate sequences 118, the least divergence module 212 may set the corresponding state sequence to be aligned to the guiding sequence 116 in a one-to-one mapping. It will be appreciated that due to the particular structure of the candidate sausage 302, the guiding sequence 116 and each of the candidate sequences 118 may have the same number of states. Therefore, any of the candidate sequences 118 may be denoted as $Q=\{q_1, q_2, \ldots q_N\}$, and share the same duration with the guiding sequence 116.

Accordingly, the least divergence module 212 may use the following approximated criterion to measure the distance between the guiding sequence 116 and each of the candidate sequences 118 (in which S represents spectrum, and f0 represents pitch):

$$D(P,Q)=\Sigma_n D_{KL}(p_n,q_n)\cdot t_n \tag{1}$$

and in which $D_{KL}(p,q)=D_{KL}^{S}(p,q)+D_{KL}^{f0}(p,q)$ is the sum of the upper-bound KLD for the spectrum and pitch parameters between two multi-space probability distribution (MSD)-HMM states:

$$D_{KL}^{S/f0}(p,q) \le (w_0^p - w_0^q)\log\frac{w_0^p}{w_0^q} + (w_1^p - w_1^q)\log\frac{w_1^p}{w_1^q} + \frac{1}{2}tr\left\{\begin{array}{l}\left(w_1^p\sum_p^{-1} + w_1^q\sum_q^{-1}\right)(\mu_p-\mu_q)^{\top} + \\ w_l^p\left(\sum_p\sum_q^{-1} - I\right) + w_l^q\left(\sum_p\sum_q^{-1} - I\right)\end{array}\right\} + \frac{1}{2}(w_1^q - w_1^p)\log\left|\sum_p\sum_q^{-1}\right| \tag{2}$$

in which $w_0$, and $w_1$ may represent prior probabilities of the discrete and continuous sub-space (for $D_{KL}^{S}(p,q)$, $w_0\equiv 0$ and $w_1\equiv 1$), and $\mu$ and $\Sigma$ may be mean and variance parameters, respectively.

By using equations (1) and (2), spectrum, pitch and duration may be embedded in a single distance measure. Accordingly, the least divergence module 212 may select an optimal sequence of rich context models 120 from the rich context model candidate sausage 302 by minimizing the total distance D(P,Q). In various embodiments, the least divergence module 212 may select the optimal sequence 120 by choosing the best rich context candidate models for every node of the candidate sausage 302 to form the optimal global solution.

The unit pruning module 214, in combination with the cross correlation module 216 and the waveform concatenation module 218, may also determine the optimal sequence 120 from a rich context model candidate sausage, such as the candidate sausage 302 of the input text 106. Thus, in some embodiments, the combination of the unit pruning module 214, the cross correlation module 216, and the wave concatenation module 218, may be implemented as an alternative to the least divergence module 212.

The unit pruning module 214 may prune sequences of candidate sequences of rich context models 118 encompassed in the candidate sausage 302 that are farther than a predetermined distance from the guiding sequence 116. In other words, the unit pruning module 214 may select for one or more candidate sequences 118 with less than a predetermined amount of distortion from the guiding sequence 116.

During operation, the unit pruning module 214 may first consider the spectrum and pitch information to perform pruning within each sausage node of the candidate sausage 302. For example, given sausage node i, and that the guiding sequence 116 is denoted by $P_i=\{p_i(1), p_i(2), \ldots p_i(S)\}$, the corresponding state duration of node i may be represented by $T_i=\{t_i(1), t_i(2), \ldots t_i(S)\}$. Further, for all $N_i$ rich context model candidates $Q_i^{1\leq j\leq N_i}$ in the node i, the state sequences of each candidate may be assumed to be aligned to the guiding sequence 116 in a one-to-one mapping. This is because in the structure of candidate sausage 302, both the guiding sequence 116 and each of the candidate sequences 118 may have the same number of states. Therefore, the candidate state sequences may be denoted as $Q_i^j=\{q_j^i(1), q_j^i(2), \ldots q_j^i(S)\}$, wherein each candidate sequence share the same duration $T^i$ with the guiding sequence 116.

Thus, the unit pruning module 214 may use the following approximated criterion to measure the distance between the guiding sequence 116 and each of the candidate sequences 118:

$$D(P_i, Q_i^j)=\Sigma_s D_{KL}(p_i(s), q_i^j(s))\cdot t_i(s) \tag{3}$$

in which $D_{KL}(p,q)=D_{KL}^S(p,q)+D_{KL}^{f0}(p,q)$ is the sum of the upper-bound KLD for the spectrum and pitch parameters between two multi-space probability distribution (MSD)-HMM states:

$$D_{KL}^{S/f0}(p, q) \leq (w_0^p - w_0^q)\log\frac{w_0^p}{w_0^q} + (w_1^p - w_1^q)\log\frac{w_1^p}{w_1^q} + \frac{1}{2}tr\left\{\begin{matrix}\left(w_1^p\sum_p^{-1} + w_1^q\sum_q^{-1}\right)(\mu_p - \mu_q)^\top + \\ w_1^p\left(\sum_p\sum_q^{-1} - I\right) + w_1^q\left(\sum_p\sum_q^{-1} - I\right)\end{matrix}\right\} + \frac{1}{2}(w_1^q - w_1^p)\log\left|\sum_p\sum_q^{-1}\right| \tag{4}$$

and in which $w_0$, and $w_1$ may be prior probabilities of the discrete and continuous sub-space (for $D_{KL}^S(p,q)$, $w_0\equiv 0$ and $w_1\equiv 1$), and $\mu$ and $\Sigma$ may be mean and variance parameters, respectively.

Moreover, by using equations (3) and (4), as well as a beam width of $\beta$, the unit pruning module 214 may prune those candidate sequences 118 for which:

$$D(P_i, Q_i^j) > \min_{1\leq j\leq N_i} D(P_i, Q_i^j) + \beta\Sigma_s t_i \tag{5}$$

Accordingly, for each sausage node, only the one or more candidate sequences 118 with distortions that are below a predetermined threshold from the guiding sequence 116 may survive pruning. In various embodiments, the distortion may be calculated based not only on the static parameters of the models, but also their delta and delta-delta parameters.

The unit pruning module 214 may also consider duration information to perform pruning within each sausage node of the candidate sausage 302. In other words, the unit pruning module 214 may further prune candidate sequences 118 with durations that do not fall within a predetermined duration interval. In at least one embodiment, for a sausage node i, the target phone-level mean and variance given by a conventional HMM-based duration model may be represented by $\mu_i$ and $\sigma_i^2$, respectively. In such an embodiment, the unit pruning module 214 may prune those candidate sequences 118 for which:

$$|d_i^j - \mu_i| > \gamma\sigma_i \tag{6}$$

in which $d_i^j$ is the duration of the $j^{th}$ candidate sequence, and $\gamma$ is a ratio controlling the pruning threshold.

In some embodiments, the unit pruning module 214 may perform the calculations in equations (3) and (4) in advance, such as during an off-line training phase, rather than during an actual run-time of the speech synthesis. Accordingly, the unit pruning module 214 may generate a KLD target cost table 230 during the advance calculation that stores the target cost data. The target cost table 230 may be further used during a search for an optimal rich context unit path.

The cross correlation module 216 may search for an optimal rich context unit path through rich context models of the one or more candidate sequences 118 in the candidate sausage 302 that have survived pruning. In this way, the cross correlation module 216 may derive the optimal rich context model sequence 120. The optimal rich model sequence 120 may be the smoothest rich context model sequence. In various embodiments, the cross correlation module 216 may implement the search as a search for a path with minimal concatenation cost. Accordingly, the optimal sequence 120 may be a minimal concatenation cost sequence.

The waveform concatenation module 218 may concatenate waveform units along a path of the derived optimal rich context model sequence 120 to form an optimized waveform sequence. The optimized waveform sequence may be further converted into synthesized speech. In various embodiments, the waveform concatenation module 218 may use a normalized cross correlation as the measure of concatenation smoothness. Given two time series x(t), y(t), and an offset of d, the cross correlation module 216 may calculate the normalized cross correlation r(d) as follows:

$$r(d) = \frac{\sum_t [(x(t)) - \mu_x \cdot (y(t-d) - \mu_y)]}{\sqrt{\sum_t [x(t) - \mu_x]^2} \cdot \sqrt{\sum_t [y(t-d) - \mu_y]^2}} \tag{7}$$

in which $\mu_x$, and $\mu_y$ are the mean of x(t) and y(t) within the calculating window, respectively. Thus, at each concatenation point in the sausage 302, and for each waveform pair, the waveform concatenation module 216 may first calculate the best offset d that yields the maximal possible r(d), as illustrated in FIG. 4.

Figure 4:
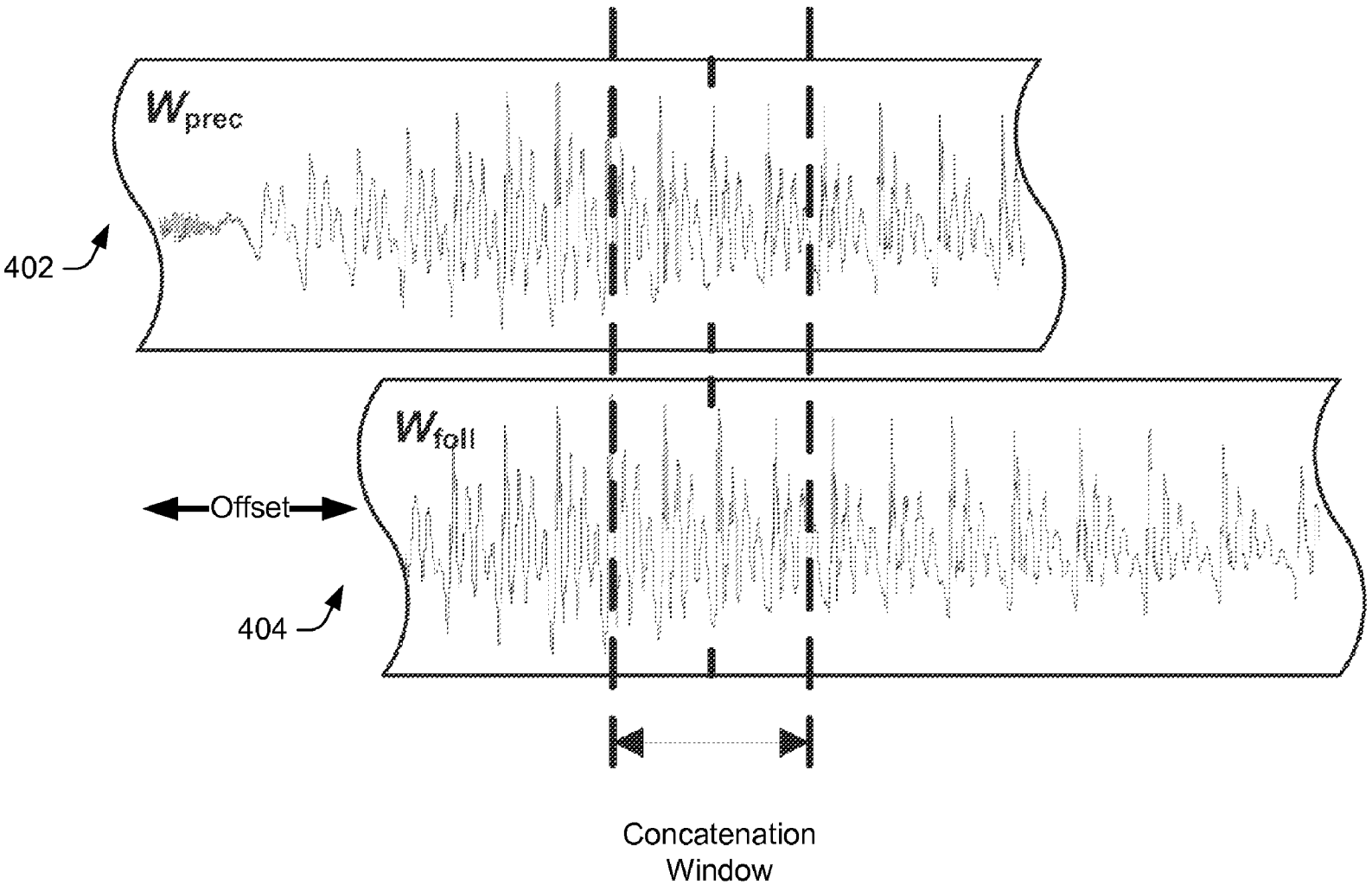
FIG. 4 illustrates waveform concatenation along a path of a selected optimal rich context model sequence to form an optimized wave sequence, in accordance with various embodiments.

FIG. 4 illustrates waveform concatenation along a path of a selected optimal rich context model sequence to form an optimized wave sequence, in accordance with various embodiments. As shown, for a preceding waveform unit $W_{prec}$ 402 and the following unit $W_{foll}$ 404, the waveform concatenation module 218 may fix a concatenation window of length L at the end of the $W_{prec}$ 402. Further, the waveform concatenation module 218 may set the range of the offset d to be [−L/2, L/2], so that $W_{foll}$ 404 may be allowed to shift within that range to obtain the maximal d(r). In at least some embodiments of waveform concatenation, the following waveform unit $W_{foll}$ 404 may be shifted according to an offset r that yields an optimal d(r). Further, a triangle fade-in/fade-out window may be applied on the preceding waveform unit $W_{prec}$ 402 and following waveform unit $W_{foll}$ 404 to perform cross fade-based waveform concatenation. Finally, the waveform sequence that has the maximal, accumulated d(r) may be chosen as the optimal path.

Returning to FIG. 2, it will be appreciated that the calculation of the normalized cross-correlation in equation (7) may introduce a lot of input/output (I/O) and computation efforts if the waveform units are loaded during run-time of the speech synthesis. Thus, in some embodiments, the waveform concatenation module 218 may calculate the normalized cross-correlation in advance, such as during an off-line training phase, to build a concatenation cost table 232. Thus, the concatenation cost table 232 may be further used during waveform concatenation along the path of the selected optimal rich context model sequence.

Following the selection of the optimal sequence of the rich context models 120 or a waveform sequence that is derived from the optimal sequence 120, the text-to-speech engine 102 may further use the synthesis module 220 to process the optimal sequence 120 or the waveform sequence into synthesized speech 108.

The synthesis module 220 may process the optimal sequence 120, or the waveform sequence that is derived from the optimal sequence 120, into synthesized speech 108. In various embodiments, the synthesis module 220 may use the predicted speech data from the input text 106, such as the speech patterns, line spectral pair (LSP) coefficients, fundamental frequency, gain, and/or the like, in combination with the optimal sequence 120 or the waveform sequence to generate the synthesized speech 108.

The user interface module 222 may interact with a user via a user interface (not shown). The user interface may include a data output device (e.g., visual display, audio speakers), and one or more data input devices. The data input devices may include, but are not limited to, combinations of one or more of keypads, keyboards, mouse devices, touch screens, microphones, speech recognition packages, and any other suitable devices or other electronic/software selection methods. The user interface module 222 may enable a user to input or select the input text 106 for conversion into synthesized speech 108.

The application module 224 may include one or more applications that utilize the text-to-speech engine 102. For example, but not as a limitation, the one or more applications may include a global positioning system (GPS) navigation application, a dictionary application, a text messaging application, a word processing application, and the like. Accordingly, in various embodiments, the text-to-speech engine 102 may include one or more interfaces, such as one or more application program interfaces (APIs), which enable the application module 224 to provide input text 106 to the text-to-speech engine 102.

The input/output module 226 may enable the text-to-speech engine 102 to receive input text 106 from another device. For example, the text-to-speech engine 102 may receive input text 106 from at least one of another electronic device, (e.g., a server) via one or more networks. Moreover, the input/output module 226 may also provide the synthesized speech 108 to the audio speakers for acoustic output, or to the data storage module 228.

As described above, the data storage module 228 may store the refined rich context models 112. The data storage module 228 may further store the input text 106, as well as rich context models 110, decision tree-tied HMMs 114, the guiding sequence of HMM models 116, the plurality of candidate sequences of rich context models 118, the optimal sequence 120, and the synthesized speech 108. However, in embodiments in which the target cost table 230 and the concatenation cost able 232 are generated, the data storage module may store tables 230-232 instead of the rich context models 110 and the decision tree-tied HMMs 114. The one or more input texts 106 may be in various forms, such as documents in various formats, downloaded web pages, and the like. The data storage module 228 may also store any additional data used by the text-to-speech engine 102, such as various additional intermediate data produced during the production of the synthesized speech 108 from the input text 106, e.g., waveform sequences.

Example Processes

Figure 5:
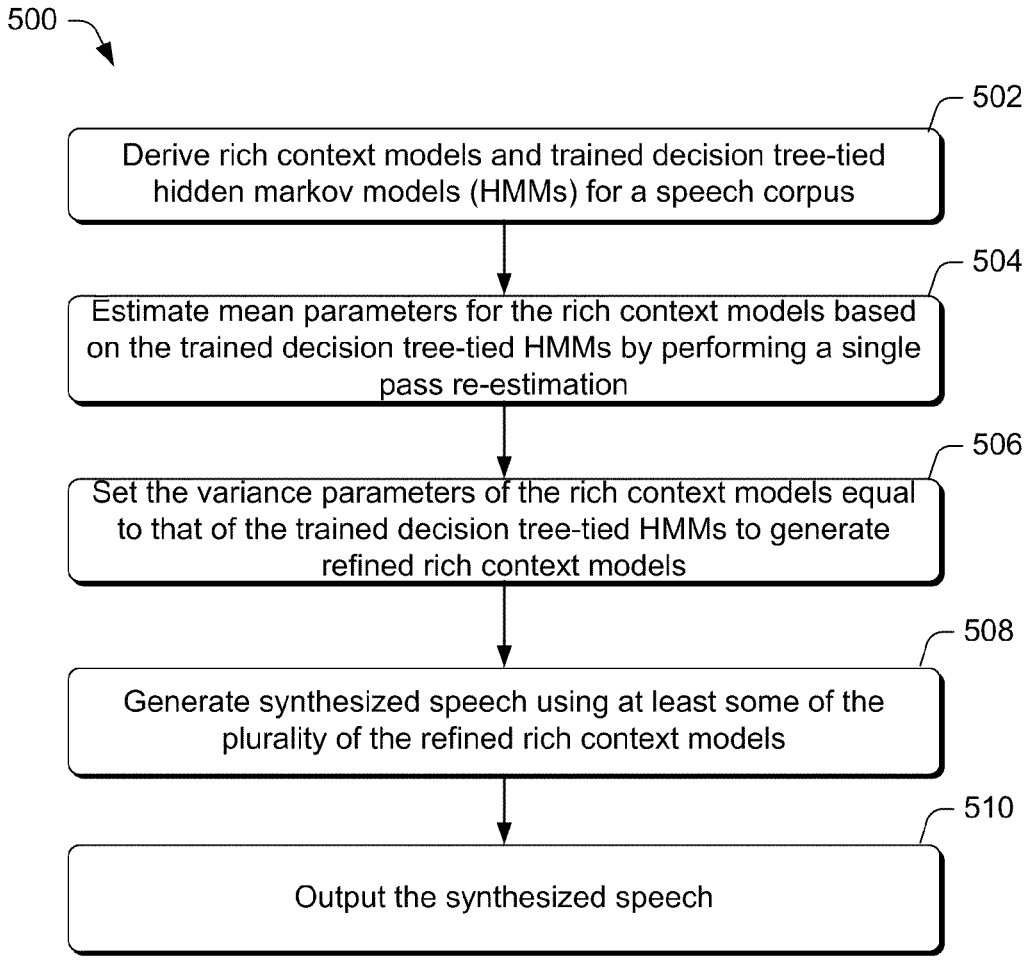
FIG. 5 is a flow diagram that illustrates an example process to generate synthesized speech from input text via the use of rich context modeling, in accordance with various embodiments.
Figure 6:
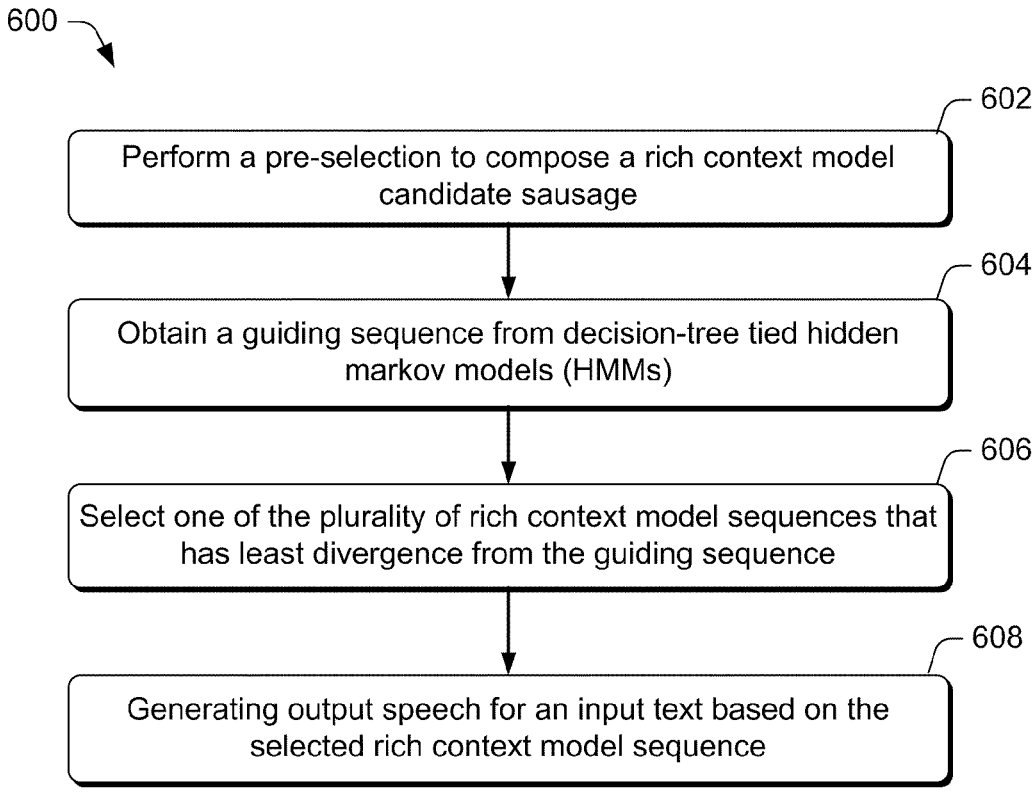
FIG. 6 is a flow diagram that illustrates an example process to synthesize speech that includes a least convergence selection of a rich context model sequence from a plurality of rich context model sequences, in accordance with various embodiments.

FIGS. 5-6 describe various example processes for implementing rich context modeling for generating synthesized speech in the text-to-speech engine 102. The order in which the operations are described in each example process is not intended to be construed as a limitation, and any number of the described blocks can be combined in any order and/or in parallel to implement each process. Moreover, the blocks in the FIGS. 5-6 may be operations that can be implemented in hardware, software, and a combination thereof. In the context of software, the blocks represent computer-executable instructions that, when executed by one or more processors, cause one or more processors to perform the recited operations. Generally, computer-executable instructions include routines, programs, objects, components, data structures, and the like that cause the particular functions to be performed or particular abstract data types to be implemented.

FIG. 5 is a flow diagram that illustrates an example process to generate synthesized speech from input text via the use of rich context modeling, in accordance with various embodiments.

At block 502, the training module 206 of the text-to-speech engine 102 may derive rich context models 110 and trained decision tree-tied HMMs 114 based on a speech corpus. The speech corpus may be a corpus of one of a variety of languages, such as English, French, Chinese, Japanese, etc.

At block 504, the training module 206 may further estimate the mean parameters of the rich context models 110 based on the trained decision tree-tied HMMs 114. In at least one embodiment, the training module 206 may perform the estimation of the mean parameters via a single pass re-estimation. The single pass re-estimation may use the trained decision tree-tied HMMs 114 to obtain the state level alignment of the speech corpus. The mean parameters of the rich context models 110 may be estimated according this alignment.

At block 506, based on the estimated mean parameters, the training module 206 may set the variance parameters of the rich context models 110 equal to that the trained decision tree-tied HMMs 114. Thus, the training module 206 may produce refined rich context models 112 via blocks 502-506.

At block 508, the text-to-speech engine 102 may generate synthesized speech 108 for an input text 106 using at least some of the refined rich context models 112.

At block 510, the text-to-speech engine 102 may output the synthesized speech 108. In various embodiments, the electronic device 104 on which the text-to-speech engine 102 resides may use speakers to transmit the synthesized speech 108 as acoustic energy to be heard by a user. The electronic device 104 may also store the synthesized speech 108 as data in the data storage module 228 for subsequent retrieval and/or output.

FIG. 6 is a flow diagram that illustrates an example process 600 to synthesize speech that includes least convergence selection of one of a plurality of rich context model sequences, in accordance with various embodiments. The example process 600 may further illustrate block 508 of the example process 500.

At block 602, the pre-selection module 208 of the text-to-speech engine 102 may perform a pre-selection of the refined rich context models 112. The pre-selection may compose a rich context model candidate sausage 302.

At block 604, the HMM sequence module 210 may obtain a guiding sequence 116 from the decision tree-tied HMMs 114 that corresponds to the input text 106. In various embodiments, the HMM sequence module may obtain the guiding sequence of decision tree-tied HMMs 116 from the set of decision tree-tied HMMs 114 using conventional techniques.

At block 606, the least divergence module 212 may obtain the optimal sequence 120 from a rich context model candidate sausage, such as the candidate sausage 302 of the input text 106. The candidate sausage 302 may encompass the plurality of rich context model candidate sequences 118. In various embodiments, the least divergence module 212 may select the optimal sequence 120 by finding a rich context model sequence with the "shortest" measured distance from the guiding sequence 116 that is included in the plurality of rich context model candidate sequences 118.

At block 608, the synthesis module 220 may generate and output synthesized speech 108 based on the selected optimal sequence 120 of rich context models.

Figure 7:
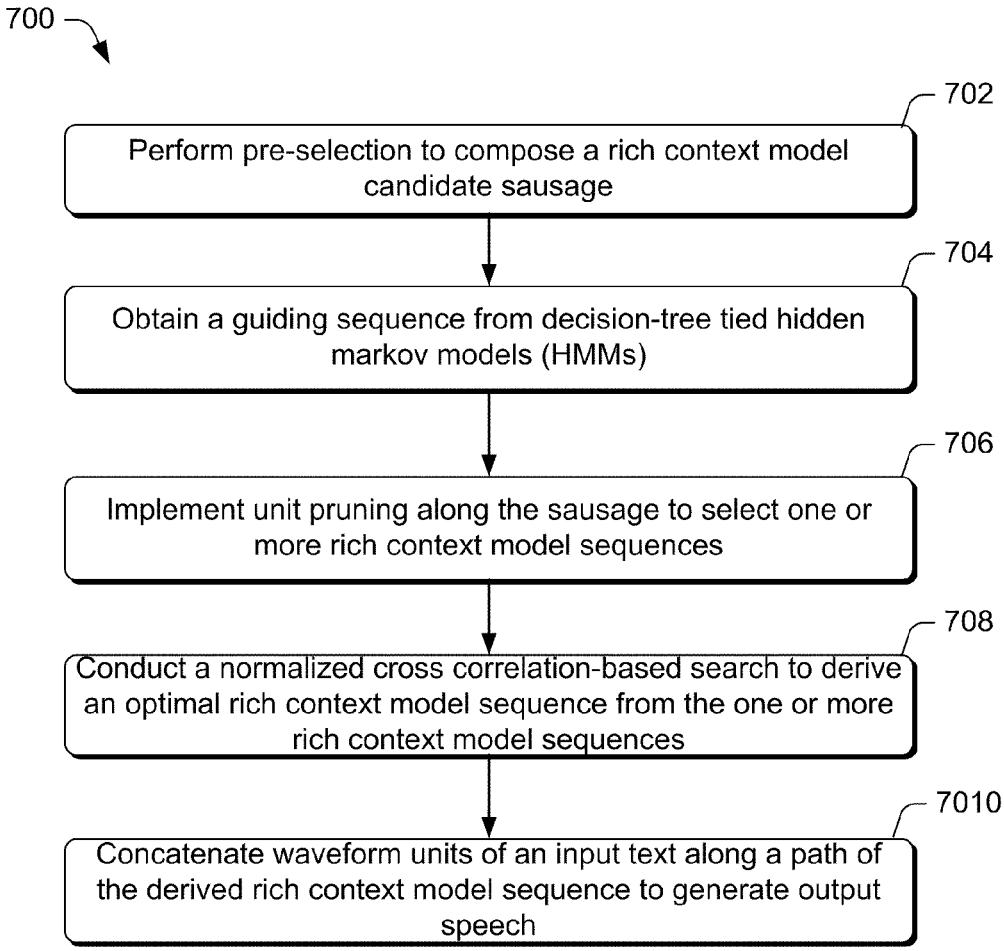
FIG. 7 is a flow diagram that illustrates an example process to synthesize speech via cross correlation derivation of a rich context model sequence from a plurality of rich context model sequences, as well as waveform concatenation, in accordance with various embodiments.

FIG. 7 is a flow diagram that illustrates an example process to synthesize speech via cross correlation derivation of a rich context model sequence from a plurality of rich context model sequences, as well as waveform concatenation, in accordance with various embodiments.

At block 702, the pre-selection module 208 of the text-to-speech engine 102 may perform a pre-selection of the refined rich context models 112. The pre-selection may compose a rich context model candidate sausage 302.

At block 704, the HMM sequence module 210 may obtain a guiding sequence 116 from the decision tree-tied HMMs 114 that corresponds to the input text 106. In various embodiments, the HMM sequence module may obtain the guiding sequence of decision tree-tied HMMs 116 from the set of decision tree-tied HMMs 114 using conventional techniques.

At block 706, the unit pruning module 214 may prune sequences of rich context model candidate sequences 118 of rich context models encompassed in the candidate sausage 302 that are farther than a predetermined distance from the guiding sequence 116. In other words, the unit pruning module 214 may select one or more candidate sequences 118 that are within a predetermined distance from the guiding sequence 116. In various embodiments, the unit pruning module 214 may perform the pruning based on spectrum, pitch, and duration information of the candidate sequences 118. In at least one of such embodiments, the unit pruning module 214 may generate the target cost table 230 in advance of the actual speech synthesis. The target cost table 230 may facilitates the pruning of the sequences of rich context model candidate sequences 118.

At block 708, the cross correlation search module 216 may conduct a cross correlation-based search to derive the optimal rich context model sequence 120 encompassed in the candidate sausage 302 from the one or more candidate sequences 118 that survived the pruning. In various embodiments, the cross correlation module 216 may implement the search for the optimal sequence 120 as a search for a minimal concatenation cost path through the rich context models of the one or more surviving candidate sequences 118. Accordingly, the optimal sequence 120 may be a minimal concatenation cost sequence. In some embodiments, the waveform concatenation module 218 may calculate the normalized cross-correlation in advance of the actual speech synthesis to build a concatenation cost table 232. The concatenation cost table 232 may be used to facilitate the selection of the optimal rich context model sequence 120.

At block 710, the waveform concatenation module 218 may concatenate waveform unit along a path of the derived optimal sequence 120 to form an optimized wave sequence. The synthesis module 220 may further convert the optimized wave sequence into synthesized speech.

Example Computing Device

Figure 8:
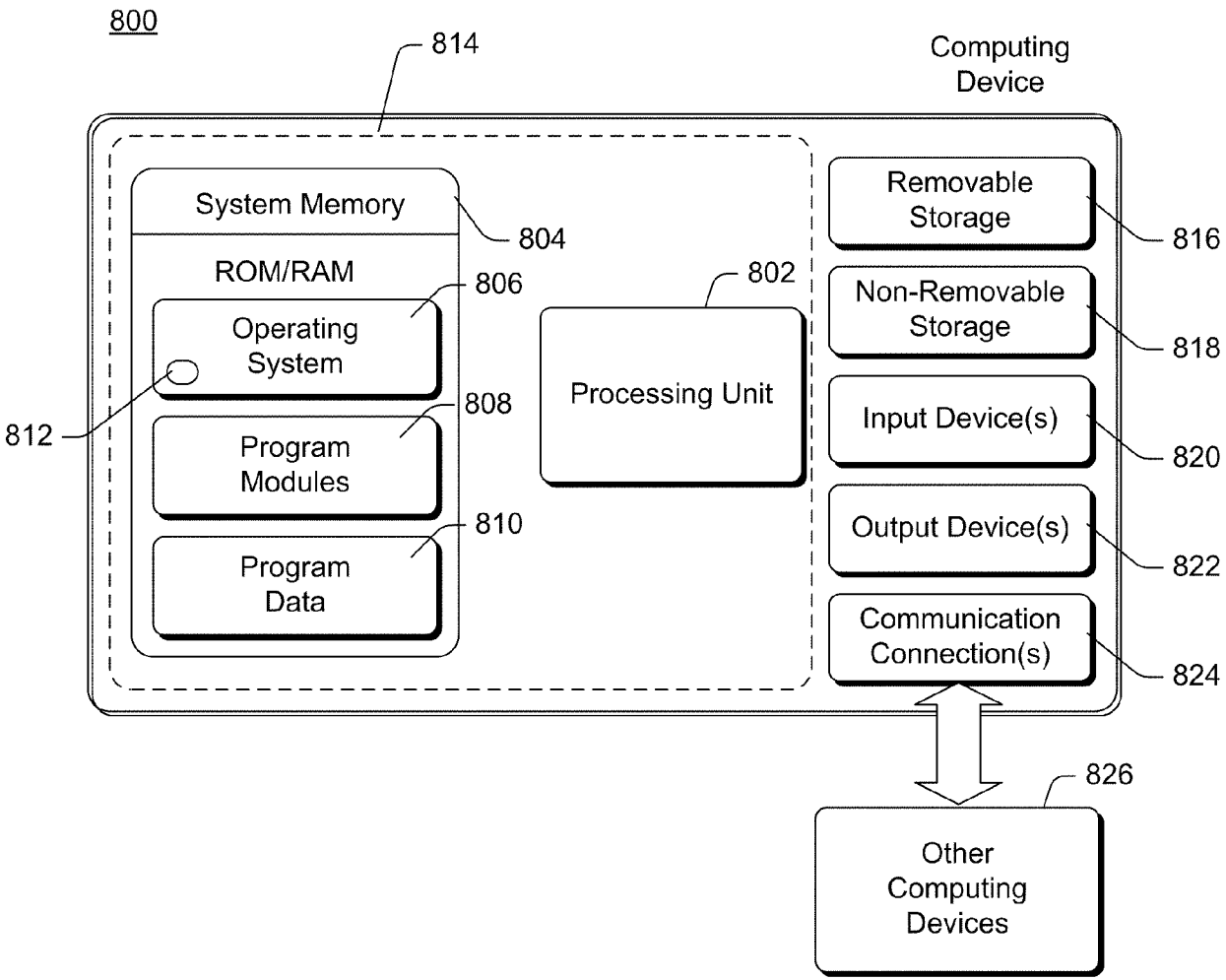
FIG. 8 is a block diagram that illustrates a representative computing device that implements rich context modeling for text-to-speech engines.

FIG. 8 illustrates a representative computing device 800 that may be used to implement a text-to-speech engine (e.g., text-to-speech engine 102) that uses rich context modeling for speech synthesis. However, it will readily appreciate that the techniques and mechanisms may be implemented in other computing devices, systems, and environments. The computing device 800 shown in FIG. 8 is only one example of a computing device and is not intended to suggest any limitation as to the scope of use or functionality of the computer and network architectures. Neither should the computing device 800 be interpreted as having any dependency or requirement relating to any one or combination of components illustrated in the example computing device.

In at least one configuration, computing device 800 typically includes at least one processing unit 802 and system memory 804. Depending on the exact configuration and type of computing device, system memory 804 may be volatile (such as RAM), non-volatile (such as ROM, flash memory, etc.) or some combination thereof. System memory 804 may include an operating system 806, one or more program modules 808, and may include program data 810. The operating system 806 includes a component-based framework 812 that supports components (including properties and events), objects, inheritance, polymorphism, reflection, and provides an object-oriented component-based application programming interface (API), such as, but by no means limited to, that of the .NET™ Framework manufactured by the Microsoft® Corporation, Redmond, Wash. The computing device 800 is of a very basic configuration demarcated by a dashed line 814. Again, a terminal may have fewer components but may interact with a computing device that may have such a basic configuration.

Computing device 800 may have additional features or functionality. For example, computing device 800 may also include additional data storage devices (removable and/or non-removable) such as, for example, magnetic disks, optical disks, or tape. Such additional storage is illustrated in FIG. 8 by removable storage 816 and non-removable storage 818. Computer storage media may include volatile and nonvolatile, removable and non-removable media implemented in any method or technology for storage of information, such as computer readable instructions, data structures, program modules, or other data. System memory 804, removable storage 816 and non-removable storage 818 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 800. Any such computer storage media may be part of device 800. Computing device 800 may also have input device(s) 820 such as keyboard, mouse, pen, voice input device, touch input device, etc. Output device(s) 822 such as a display, speakers, printer, etc. may also be included.

Computing device 800 may also contain communication connections 824 that allow the device to communicate with other computing devices 826, such as over a network. These networks may include wired networks as well as wireless networks. Communication connections 824 are some examples of communication media. Communication media may typically be embodied by computer readable instructions, data structures, program modules, etc.

It is appreciated that the illustrated computing device 800 is only one example of a suitable device and is not intended to suggest any limitation as to the scope of use or functionality of the various embodiments described. Other well-known computing devices, systems, environments and/or configurations that may be suitable for use with the embodiments include, but are not limited to personal computers, server computers, hand-held or laptop devices, multiprocessor systems, microprocessor-base systems, set top boxes, game consoles, programmable consumer electronics, network PCs, minicomputers, mainframe computers, distributed computing environments that include any of the above systems or devices, and/or the like.

The implementation of text-to-speech engines that uses rich context models in HMM-based synthesis may generate speech with crisper formant structures and richer details than those obtained from conventional HMM-based speech synthesis. Accordingly, the use of rich context models in HMM-based speech synthesis may provide synthesized speech that is more natural sounding. As a result, user satisfaction with embedded systems that present information via synthesized speech may be increased at a minimal cost.

CONCLUSION

In closing, although the various embodiments have been described in language specific to structural features and/or methodological acts, it is to be understood that the subject matter defined in the appended representations is not necessarily limited to the specific features or acts described. Rather, the specific features and acts are disclosed as exemplary forms of implementing the claimed subject matter.

The invention claimed is:

1. A computer readable medium storing computer-executable instructions that, when executed, cause one or more processors to perform acts comprising:

obtaining trained decision tree-tied hidden Markov Models (HMMs) for a speech corpus;

estimating mean parameters of a plurality of rich context models based on the trained decision tree-tied HMMs by performing a single pass re-estimation;

setting variance parameters of the plurality of rich context models equal to the variance parameters of the trained decision tree-tied HMMs to produce a plurality of refined rich context models; and generating synthesized speech for an input text based at least on some of the plurality of refined rich context models.

2. The computer readable medium of claim 1, wherein the single pass re-estimate further obtains a state-level alignment of the speech corpus based on the trained decision tree-tied HMMs.

3. The computer readable medium of claim 1, further storing an instruction that, when executed, cause the one or more processors to perform an act comprising outputting the synthesized speech to at least one of an acoustic speaker or a data storage.

4. The computer readable medium of claim 1, wherein the generating comprises:

performing pre-selection to compose a rich context model candidate sausage for the input text, the candidate sausage including a plurality of refined rich context model sequences, each sequence including at least some refined rich context models from the plurality of refined rich context models;

selecting one of the plurality of refined rich context model sequences that has a least divergence from a guiding sequence that is obtained from the decision tree-tied HMMs; and generating output speech for the input text based at least on a rich context model sequence that is selected from the plurality of refined rich context model sequences.

5. The computer readable medium of claim 4, wherein the selecting includes searching for one of the plurality of refined rich context model sequences that has a shortest distance to the guiding sequence based on spectrum, pitch, and duration information of each sequence.

6. The computer readable medium of claim 5, wherein the searching includes searching for one of the plurality of refined rich context model sequences that has the shortest distance via a state-aligned Kullback-Leibler divergence (KLD) approximation.

7. The computer readable medium of claim 4, wherein the generating further includes synthesizing speech based further on line spectral pair (LSP) coefficients, a fundamental frequency, and a gain predicted from the input text.

8. The computer readable medium of claim 1, wherein the generating comprises:

performing pre-selection to compose a rich context model candidate sausage for the input text, the candidate sausage including a plurality of refined rich context model sequences, each sequence including at least some refined rich context models from the plurality of refined rich context models;

implementing unit pruning along the candidate sausage to select one or more rich context model sequences with less than a predetermined amount of distortion from a guiding sequence, the guiding sequence obtained from the decision tree-tied HMMs;

conducting a normalized cross correlation-based search to derive a minimal concatenation cost rich context model sequence from the one or more rich context model sequences;

concatenating waveform units of an input text along a path of the minimal concatenation cost rich context sequence to generate a waveform sequence; and generating output speech for the input text based at least on the waveform sequence.

9. The computer readable medium of claim 8, wherein the implementing includes pruning refined rich context model sequences encompassed in the candidate sausage that are farther than a predetermined distance from the guiding sequence based on spectrum, pitch, and duration information.

10. The computer readable medium of claim 8, wherein the implementing includes generating a Kullback-Leibler divergence (KLD) target cost table in advance of speech synthesis that facilitates the pruning along the candidate sausage to select the one or more rich context model sequences with less than the predetermined amount of distortion from the guiding sequence, and wherein the conducting includes generating a concatenation cost table in advance of speech synthesis to facilitate derivation of the minimal concatenation cost rich context model sequence.

11. The computer readable medium of claim 8, wherein the generating further includes synthesizing speech based further on line spectral pair (LSP) coefficients, a fundamental frequency, and a gain predicted from the input text.

12. A computer implemented method, comprising:

under control of one or more computing systems configured with executable instructions, refining a plurality of rich context models based on decision tree-tied Hidden Markov Models (HMMs) to produce a plurality of refined rich context models;

performing pre-selection to compose a rich context model candidate sausage for an input text, the candidate sausage including a plurality of refined rich context model sequences, each sequence including at least some refined rich context models from the plurality of refined rich context models;

selecting one of the plurality of refined rich context model sequences that has a least divergence from a guiding sequence that is obtained from the decision tree-tied HMMs; and generating output speech for the input text based at least on a rich context model sequence that is selected from the plurality of refined rich context model sequences.

13. The computer implemented method of claim 12, further comprising outputting the output speech to at least one of an acoustic speaker or a data storage.

14. The computer implemented method of claim 12, wherein the refining further comprises:

obtaining trained decision tree-tied hidden Markov Models (HMMs) for a speech corpus;

estimating mean parameters of the rich context models based on the trained decision tree-tied HMMs by performing a single pass re-estimation; and setting variance parameters of the rich context models equal to variance parameters of the trained decision tree-tied HMMs to produce the plurality of refined rich context models.

15. The computer implemented method of claim 12, wherein the selecting includes searching for one of the plurality of refined rich context model sequences that has a shortest distance to the guiding sequence based on spectrum, pitch, and duration information of each sequence.

16. The computer implemented method of claim 12, wherein the generating further includes synthesizing speech based further on line spectral pair (LSP) coefficients, a fundamental frequency, and a gain predicted from the input text.

17. A system, comprising:

one or more processors;

a memory that includes a plurality of computer-executable components, the plurality of computer-executable components comprising:

a training module to refine a plurality of rich context models based on decision tree-tied Hidden Markov Models (HMMs) to produce a plurality of refined rich context models;

a pre-selection module to perform pre-selection to compose a rich context model candidate sausage for an input text, the candidate sausage including a plurality of refined rich context model sequences, each sequence including at least some refined rich context models from the plurality of refined rich context models;

a unit pruning module to implement unit pruning along the candidate sausage to select one or more rich context model sequences with less than a predetermined amount of distortion from a guiding sequence, the guiding sequence obtained from the decision tree-tied HMMs;

a cross correlation search module to conduct a normalized cross correlation-based search to derive a minimal concatenation cost rich context model sequence from the one or more rich context model sequences;

a waveform concatenation module to concatenate waveform units of an input text along a path of the minimal concatenation cost rich context model sequence to generate a waveform sequence; and a synthesis module to generate synthesized speech for the input text based at least on the waveform sequence.

18. The system of claim 17, further comprising a data storage module to store the synthesized speech.

19. The system of claim 17, wherein the training module is to further:

obtain trained decision tree-tied hidden Markov Models (HMMs) for a speech corpus;

estimate mean parameters of the rich context models based on the trained decision tree-tied HMMs by performing a single pass re-estimation; and set variance parameters of the rich context models equal to variance parameters of the trained decision tree-tied HMMs to produce the plurality of refined rich context models.

20. The system of claim 17, wherein the unit pruning module is to prune the refined rich context model sequences encompassed in the candidate sausage that are farther than a predetermined distance from the guiding sequence based on spectrum, pitch, and duration information.

21. The system of claim 17, wherein the unit pruning module is to generate a Kullback-Leibler divergence (KLD) target cost table in advance of speech synthesis that facilitates pruning along the candidate sausage to select the one or more rich context model sequences with less than the predetermined amount of distortion from the guiding sequence.

22. The system of claim 17, wherein the cross correlation search module is to generate a concatenation cost table in advance of speech synthesis to facilitate derivation of the minimal concatenation cost rich context model sequence.

23. The system of claim 17, wherein the synthesis module is to synthesize speech based further on line spectral pair (LSP) coefficients, a fundamental frequency, and a gain predicted from the input text.

* * * * *